US008308322B2

(12) United States Patent
Santiago et al.

(10) Patent No.: US 8,308,322 B2
(45) Date of Patent: Nov. 13, 2012

(54) RECESSED CAN WITH SPRING LOADED RETAINER CLIPS

(75) Inventors: Dwight David Santiago, Summerfield, NC (US); Seth Chang, Rowland Heights, CA (US); Huan C. Nguyen, Anaheim, CA (US)

(73) Assignee: Cordelia Lighting, Inc., Rancho Dominguez, CA (US)

( * ) Notice: Subject to any disclaimer, the term of this patent is extended or adjusted under 35 U.S.C. 154(b) by 169 days.

(21) Appl. No.: 13/004,727

(22) Filed: Jan. 11, 2011

(65) Prior Publication Data

US 2011/0267826 A1 Nov. 3, 2011

Related U.S. Application Data

(60) Provisional application No. 61/329,501, filed on Apr. 29, 2010.

(51) Int. Cl.
*F21V 15/00* (2006.01)
*B42F 13/06* (2006.01)

(52) U.S. Cl. ..... 362/365; 362/368; 362/370; 362/404; 220/477; 248/343; 248/222.11; 248/229.16; 248/229.26

(58) Field of Classification Search ..... 362/364, 362/365, 368, 370, 371, 404; 220/477; 248/222.11, 248/222.12, 229.16, 229.26
See application file for complete search history.

(56) References Cited

U.S. PATENT DOCUMENTS

| | | | | |
|---|---|---|---|---|
| 2,063,923 | A * | 12/1936 | Gries | 220/3.6 |
| 2,744,716 | A * | 5/1956 | Zingone | 248/343 |
| 2,965,348 | A * | 12/1960 | Gerstel et al. | 248/343 |
| 5,331,531 | A * | 7/1994 | Unger et al. | 362/365 |
| 5,377,088 | A * | 12/1994 | Lecluze | 362/366 |
| 5,609,414 | A * | 3/1997 | Caluori | 362/366 |
| 5,931,432 | A * | 8/1999 | Herold et al. | 362/365 |
| 7,331,555 | B2 * | 2/2008 | St-Pierre | 248/343 |
| 7,530,717 | B2 * | 5/2009 | Magisano et al. | 362/365 |
| 7,549,780 | B2 * | 6/2009 | Caluori | 362/404 |
| 7,618,167 | B2 * | 11/2009 | Bedard | 362/364 |

OTHER PUBLICATIONS

CA Examiner's Report—Jan. 3, 2012.

* cited by examiner

*Primary Examiner* — Ismael Negron
(74) *Attorney, Agent, or Firm* — Paul Y. Feng; The Eclipse Group LLP

(57) ABSTRACT

A recessed ceiling light fixture with spring biased retainer clips that retract flush or are biased away from the side of the can housing for installation is disclosed. The fixture includes a housing having a side wall, a top wall, and an open bottom. Two rigid retainer clips are mounted diametrically opposed on the housing. Each retainer clip has a mounting tab inside the housing extending into a leg that passes out of the housing, which leg is bent to form an elbow, which elbow extends to a strut passing back into the housing, wherein the mounting tab selectively engages the side wall to limit movement of the spring clip. A bolt and coiled spring create compliance and bias in the spring clip by passing loosely through a slotted opening in the top wall at one end and joining the mounting tab at the other end.

20 Claims, 12 Drawing Sheets

12
30
48
42
46
26
36
32
28
40
50
58
16
18
52
20

ISO VIEW

TOP VIEW

SIDE VIEW

FRONT VIEW

ISO VIEW

SIDE VIEW

TOP VIEW

FRONT VIEW

RECESSED CAN WITH SPRING LOADED RETAINER CLIPS

CROSS-REFERENCES TO RELATED APPLICATIONS

This application claims priority from U.S. provisional application no. 61/329,501, filed Apr. 29, 2010, which is hereby incorporated by reference in its entirety.

BACKGROUND

Light fixtures recessed into the ceiling are popular in residential homes and commercial buildings. Recessed lighting fixtures provide a flush, aesthetic appearance that is attractive to many because the design hides the electrical hardware and wiring inside a space behind the ceiling. Typically, the light fixture comes in the form of a housing shaped like a can, and a light source with a reflective trim fitted inside the can. Wiring is fed into the can to power the light source. Mounting hardware attaches the can to the building frame, ceiling joists, or ceiling support structure.

There have been different attempts at mounting the ceiling light fixture. Examples include U.S. Pat. No. 4,293,895 (Krisofek), U.S. Pat. No. 4,733,339 (Kelsall), U.S. Pat. No. 5,377,088 (Lecluze), U.S. Pat. No. 5,609,414 (Calouri), U.S. Pat. No. 6,174,076 (Petrakis), U.S. Pat. No. 6,554,458 (Benghozi), U.S. Pat. No. 6,827,471 (Benghozi), U.S. Pat. No. 6,896,394 (Houle), U.S. Pat. No. 7,331,555 (St-Pierre), U.S. Pat. No. 7,530,717 (Magisano), U.S. Pat. No. 7,549,780 (Calouri), U.S. Pat. No. 7,618,167 (Bedard), and U.S. Patent Application Publication No. 2009/0010007 (Calouri), generally directed to recessed lighting fixtures where legs or similar structures extend from the can to mount the fixture into the ceiling space.

SUMMARY OF THE INVENTION

The present invention in various preferred embodiments is directed to a recessed ceiling light fixture comprising a housing having a side wall, a top wall up on top, and an open bottom with a lip at the bottom, a plurality of openings in the side wall, with preferably two rigid retainer clips mounted circumferentially opposed to the housing. In the preferred embodiment, each retainer clip has a mounting tab positioned inside the housing, which mounting tab extends into a leg that passes through one of the openings out of the housing, which leg is bent at a distal end to form an elbow, which elbow extends to a strut passing through one of the openings back into the housing. The mounting tab selectively engages an interior of the side wall as it moves with the retainer clip. A means for creating compliance extends loosely through a slotted opening in the top wall and connects to the mounting tab, wherein the means for creating compliance simultaneously biases the leg to swing away from the side wall and downward toward the open bottom.

The leg swing away from the side wall under spring bias is limited by at least one of the mounting tab engaging the side wall and the means for creating compliance engaging a lip of the slotted opening in the top wall. Preferably, the means for creating compliance is a threaded bolt, wherein the bolt head is outside of the housing and its shaft passes through the slotted opening in the top wall into the housing where the threaded end attaches to the mounting tab. The fitment of the bolt within the slotted opening allows the bolt to swivel and pivot freely within the slot and along the elongation of the slot. The bolt also free traverses through the slotted opening.

A coiled spring is preferably disposed on the bolt shaft captured between the top wall and the mounting tab such that there is some compression in the spring.

The loose fitment of the bolt through the slotted opening allows the entire rigid retainer clip, specifically the leg, to pivot and swing away or toward the housing, and the leg to translated up and down the outside of the housing. Preferably, the spring simultaneously biases the leg in a direction away from the housing and in a direction downward toward the open bottom of the housing.

The rigid retainer clip exhibits a rigidity that supports the weight of the recessed ceiling light fixture including internal components, wiring, lamp, etc., with minimal flexing. Further, the distal end of the strut may include a hook, a bend, a T-shaped tip, and/or a tab having a hole therethrough. Each of these structures provides a finger or thumb accessible contact surface. The tab with a hole allows a screwdriver tip to pass through. An installer or electrician can thus reach into the housing and use his or her finger or thumb on one hand to hold the opposed retainer clips, apply closing pressure to retract the retainer clips against the spring bias. This pressure moves the legs radially inward, retracting the legs relatively, substantially flush against the exterior of the housing. In this state, the fixture can be easily pushed through the cut out in the ceiling. Once passed through, the finger pressure is release allowing the retainer clips to rebound radially outward, thus deploying the spring clips and specifically placing the extended elbows in position. The fixture can now rest on the deployed spring clips.

DETAILED DESCRIPTION OF THE PREFERRED EMBODIMENTS

Figure 1:
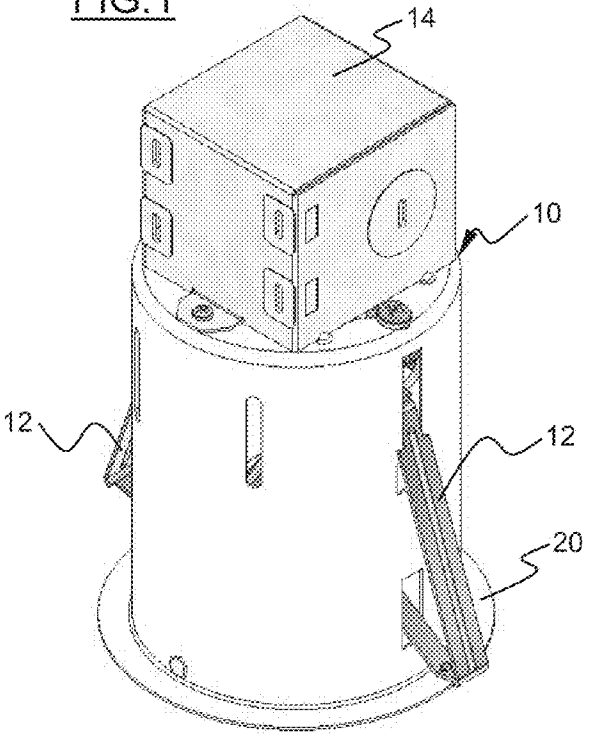
FIG. 1 is perspective view of a preferred embodiment recessed can housing assembly with spring loaded retainer clips.

As seen in FIG. 1, the present invention is directed to a recessed can housing assembly 10 with spring loaded retainer clips 12. In the preferred embodiment shown, there are two retainer clips 12 arranged diametrically opposed on the housing assembly 10. In various alternative embodiments (not shown), there can be more or fewer retainer clips 12 depending on application, size and weight of the can housing assembly with hardware, and shape of the housing. The can housing assembly 10 is intended for installation into the ceiling such that the hardware is recessed into the ceiling or ceiling panel and cannot be seen from the front or bottom side. As such, the can housing is preferably cylindrical in shape with a round top wall 18, an open bottom, and a cylindrical side wall. Other shapes for the can housing such as an elongated box are contemplated.

Figure 8:
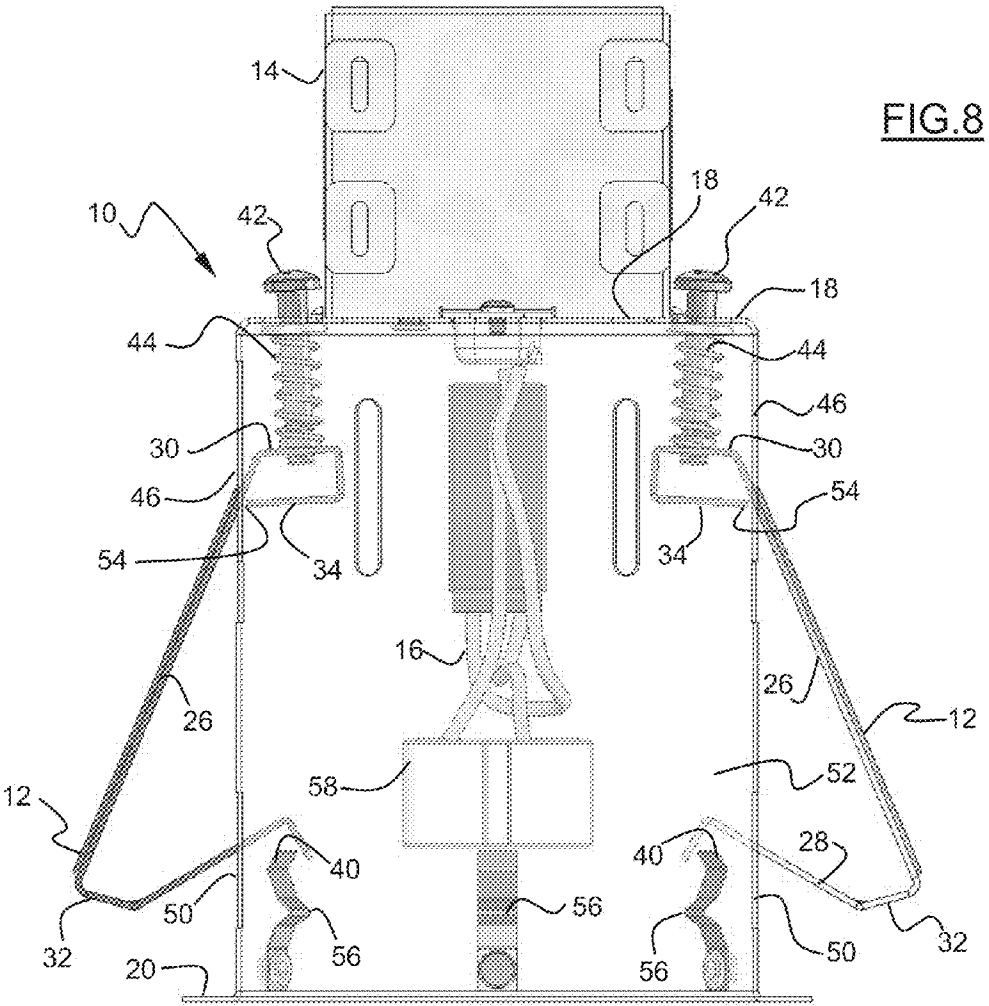
FIG. 8 is a side elevational cutaway view of the embodiment shown in FIG. 7.
Figure 9A:
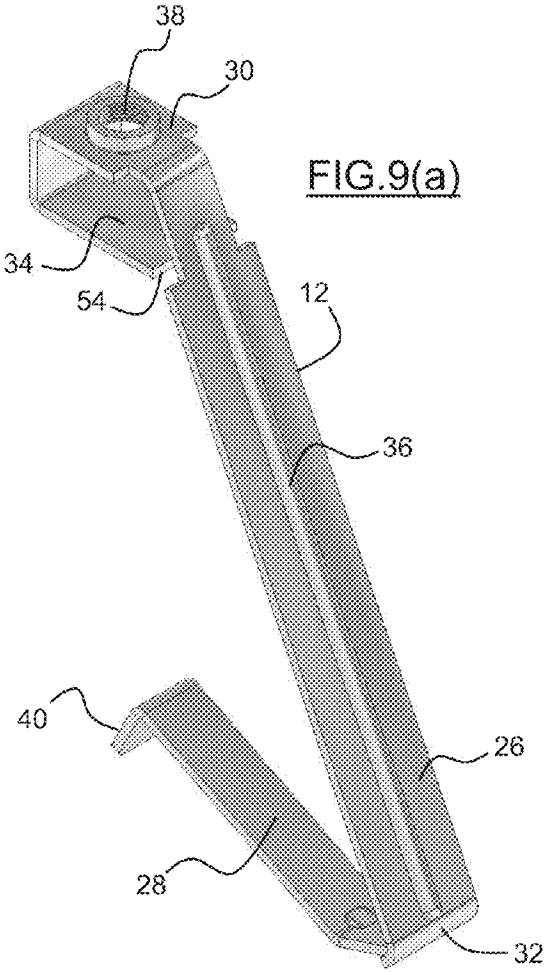
FIGS. 9(*a*)-9(*d*) are various views of the retainer clip from the embodiment shown in FIG. 7.
Figure 9B:
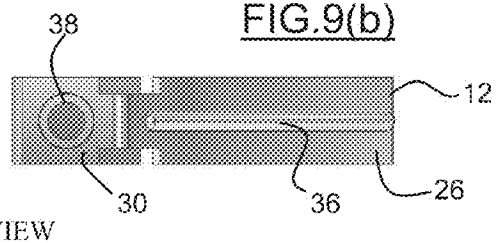
Figure 9D:
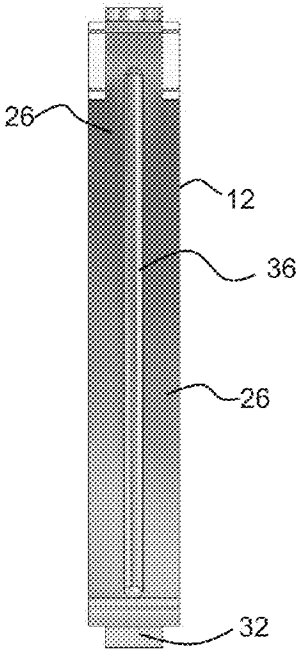
Figure 9C:
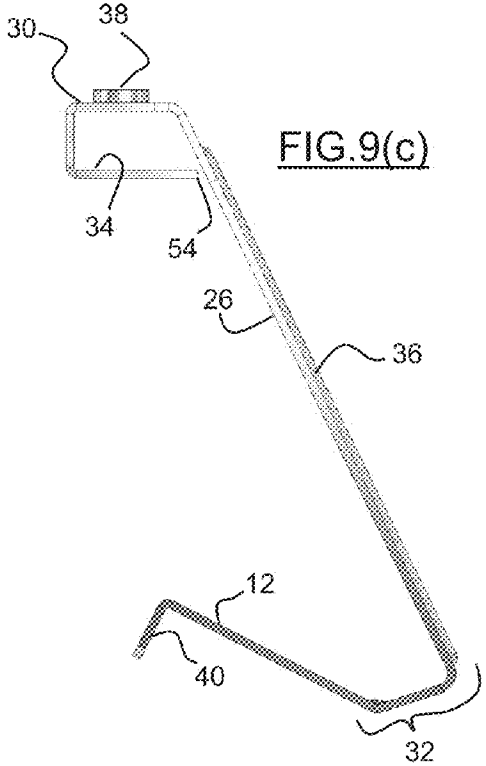

The can housing assembly 10 is intended to contain a lighting fixture having a reflector, trim, lens, etc. and/or a light source (not shown) such as an incandescent bulb, halogen bulb, a compact fluorescent light (CFL), an LED cluster, and the like. Indeed, as seen in FIG. 8, one or more brackets 56 disposed along the interior circumference of the can housing assembly 10 are adapted to receive a trim ring (not shown) that snaps into place. The trim ring in various embodiments can hold a reflective trim and the light source, and the trim ring may be gimbaled so the light from the light source can be aimed or adjusted. Power is supplied to the light source via optional junction box 14 mounted to the top of the can housing assembly 10. The junction box 14 provides a holding chamber for the confluence of electrical wiring routed to the light source inside the can housing assembly 10. The junction box 14 may also hold driver electronics and support heat sinks, etc., if the light source is an LED cluster.

Figure 2:
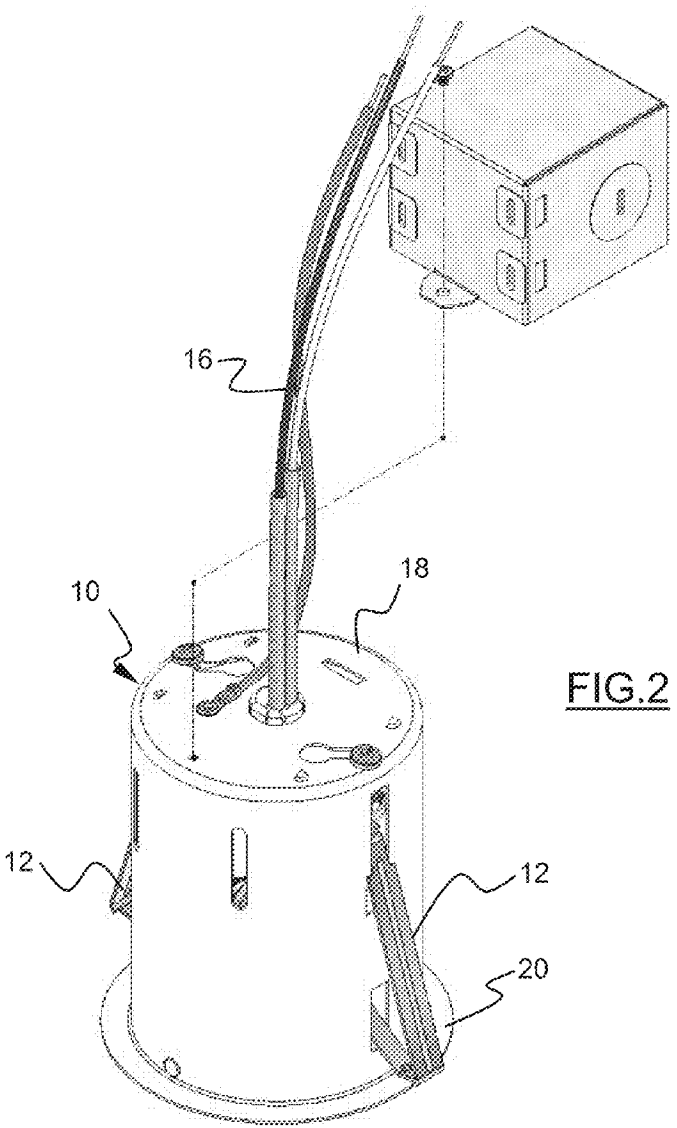
FIG. 2 is a perspective view of the FIG. 1 embodiment with the junction box removed to expose the wiring extending into the can housing.

In FIG. 2, the junction box 14 has been removed to show the electrical wiring 16 routed to the can housing assembly 10. The electrical wiring 16 passes through the top wall 18 of the can housing assembly 10 and into the interior and connects to an electrical socket 58 (FIGS. 7(*a*), 8). The socket 58 is configured to receive a lighting fixture or a light source (not shown) such as an incandescent light bulb, a fluorescent lamp, a halogen lamp, an LED cluster, or the like.

As seen in FIG. 2, the open bottom of the can housing assembly 10 has an optional flange or lip 20. The lip 20 extends around the periphery of the can housing bottom. The radially-outwardly extending lip 20 is intended to help stabilize the housing after installation into the ceiling space.

Figure 4:
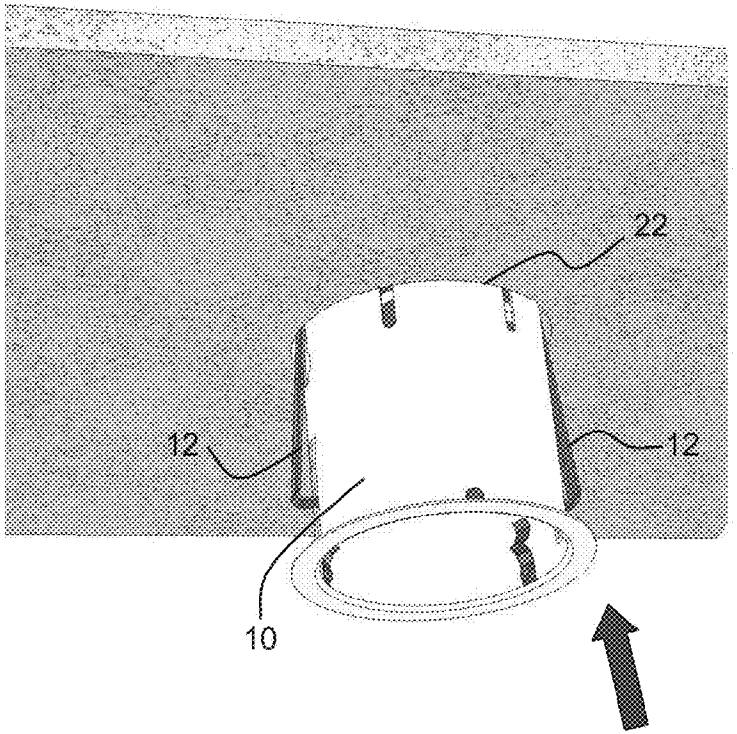
FIG. 4 is the can housing assembly passing through the ceiling cutout.
Figure 3:
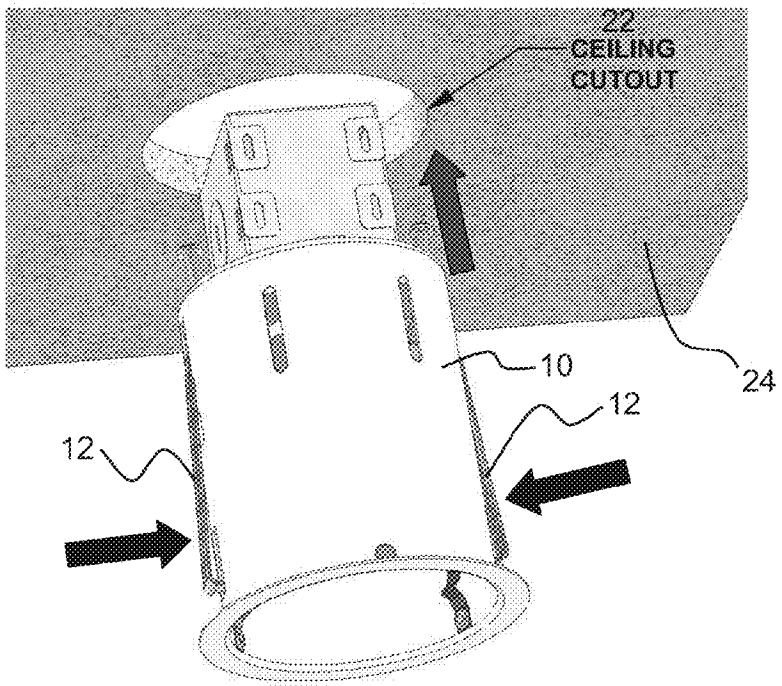
FIG. 3 is a perspective view of the FIG. 1 embodiment, as seen from beneath or in front of a ceiling panel, wherein the can housing assembly is about to be inserted through a cutout in the ceiling panel and the retainer clips are moved to a retracted condition.
Figure 6:
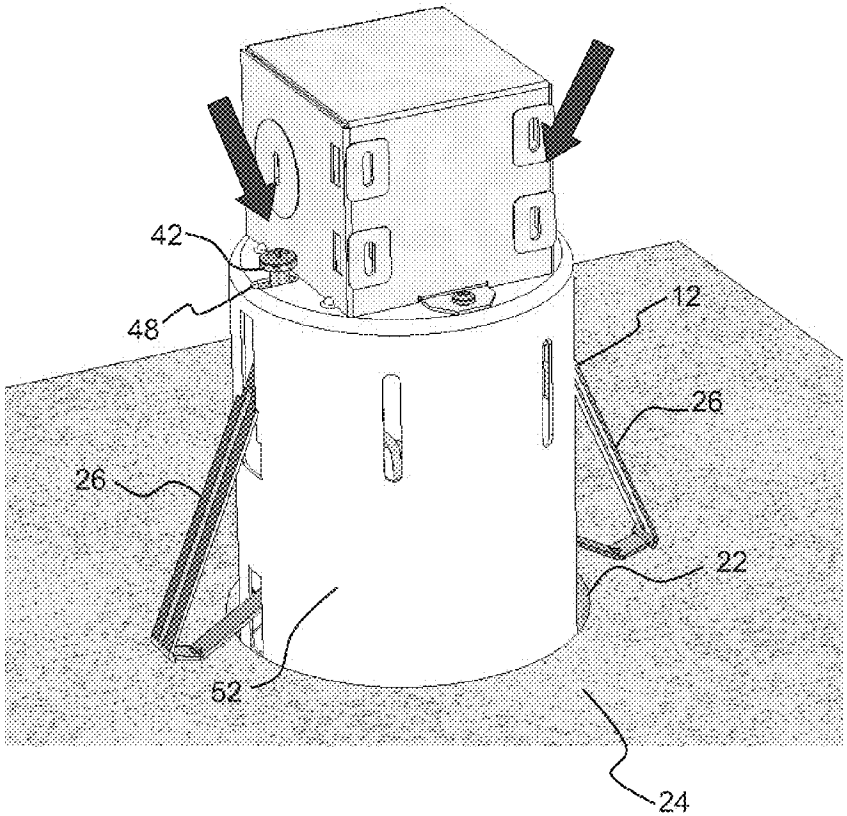
FIG. 6 is the can housing assembly with the retainer clips fully extended and supporting the weight of the can housing assembly while resting on the ceiling panel.
Figure 5:
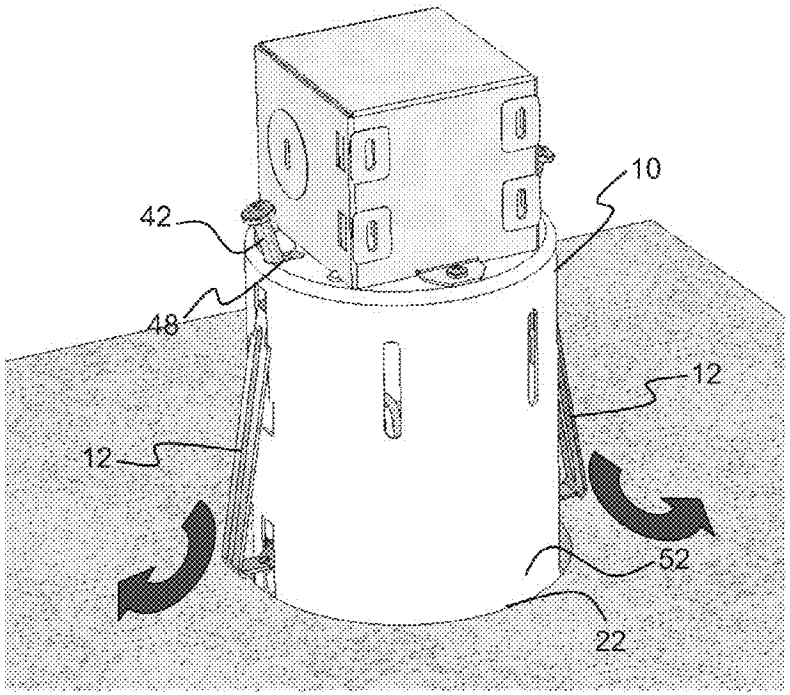
FIG. 5 is the can housing assembly fully inserted through the ceiling cutout, as seen from above or behind the ceiling panel, with the retainer clips beginning to deploy radially outward.

FIGS. 3-6 depict a sequence of events in the installation of the can housing assembly 10 through an opening or cutout 22 in a ceiling panel 24 or similar walled partition in a home or commercial office building. FIG. 3 shows the can housing assembly 10 located underneath a ceiling panel 24 being prepared for installation. Specifically, as indicated by the arrows, the retainer clips 12 are pushed from the outside of the housing radially inward and optionally pushed upward; or simultaneously pulling the retainer clips radially inward and optionally pushing them upward from the inside of the housing (described in more detail below), to a retracted position so that the can housing assembly 10 can fit within the cutout 22 and be inserted into the round ceiling cutout 22. FIG. 4 shows the insertion of the can housing assembly 10 through the cutout 22. FIG. 5 is a view from behind (or above) the ceiling panel 24, wherein the retainer clips 12 have just cleared the ceiling panel 24 and are about to translated linearly downward and deploy radially outward as indicated by the arrows. FIG. 6 shows the retainer clips 12 fully deployed radially outward and shifted downward toward the ceiling panel 24. The ceiling panel 24 is now sandwiched between the lip 20 from the front of the ceiling panel 24 and the retainer clips 12 from the behind the ceiling panel 24. The retainer clips 12 support the entire weight of the recessed can assembly 10 and the clips 12 rest on the ceiling panel 24 as shown. Accordingly, the recessed can assembly 10 can be installed quickly and without need for any tools, fasteners, or extra mounting hardware.

In fact, the retainer clips 12 can be pinched from the inside of the housing assembly 10 with one hand, and with that same hand, the can housing assembly 10 can be pushed through the cutout 22, then allow the retainer clips 12 to deploy, all using only one hand. This is very advantageous because the electrician or installer during installation will be standing atop a ladder and working overhead on these ceiling light fixtures. Thus, the one-hand installation is beneficial because it frees the electrician's other hand to stabilize himself or herself on the ladder, to hold a tool with the free hand, etc.

Figures 7A, 7B, 7C:
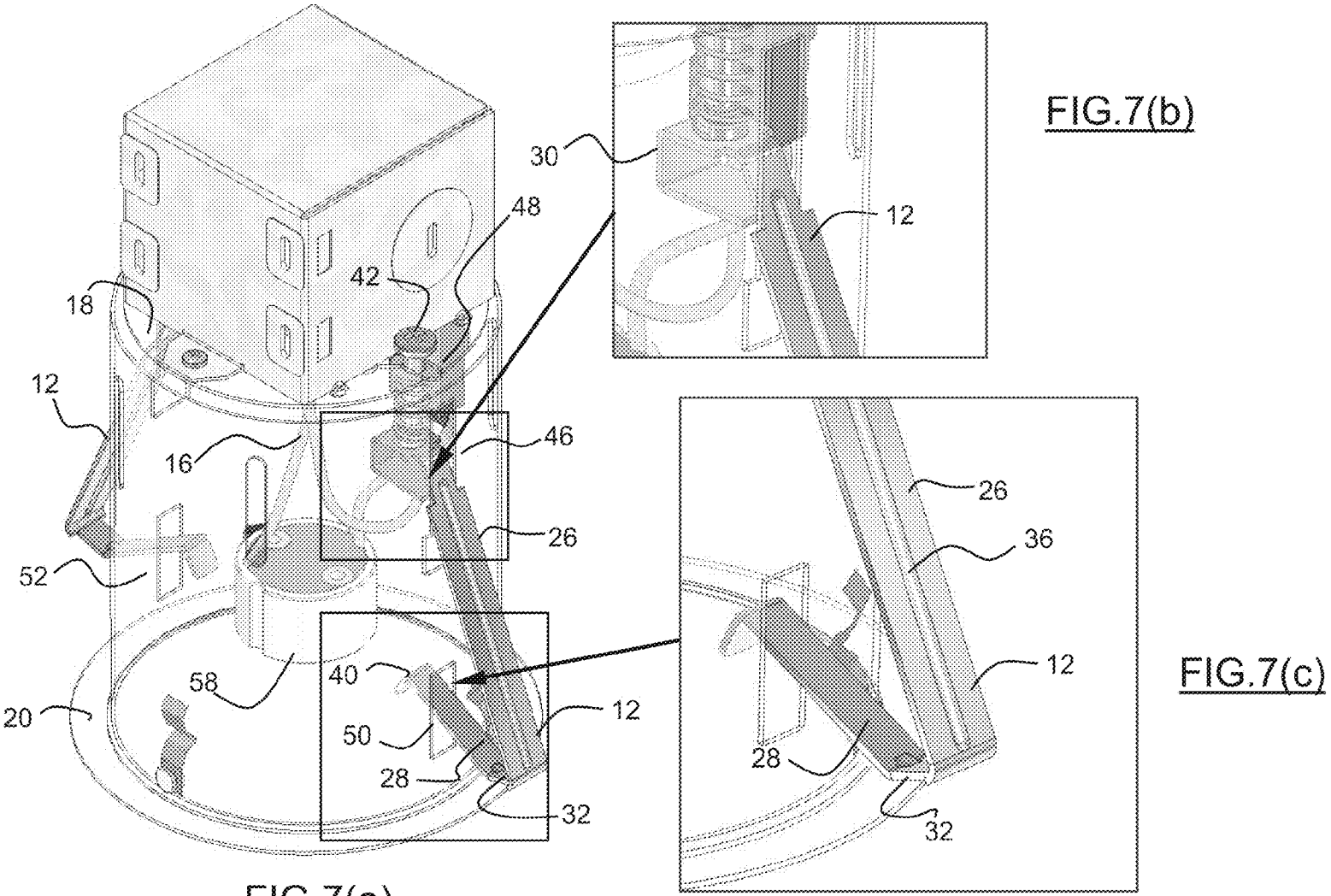
FIGS. 7(*a*)-7(*c*) are various perspective views of a preferred embodiment retainer clip used with a can housing assembly.

FIGS. 7-9 illustrate one preferred embodiment of the retainer clip 12. FIGS. 7(*a*)-(*c*) are perspective views showing how the retainer clips 12 are mounted to the can housing 52. In FIG. 7(*a*), it can be seen that the retainer clip 12 has a mounting tab 30 that transitions into a leg 26 which then is bent inward to form an elbow 32. The elbow 32 as seen in the side view of FIG. 8 may have a flat section, or may have a V-shaped vertex without the flat section. The flat section provides move surface area to reduce the stress when the light fixture is installed, which stress if excessive might cause the elbow 32 to gouge and damage a ceiling tile which in some applications is made from a soft or brittle plaster.

The elbow 32 transitions into a strut 28 pointed inward toward the center of the housing 52. An optional bent tip 40 at the distal end of the strut 28 gives purchase for thumb and finger contact for installation. In this preferred embodiment, the mounting tab 30 is disposed inside the can housing 52. At least a portion of the leg 26 extends from the mounting tab 30 out through a slotted opening 46 in the side wall of the housing 52 to the exterior. The strut 28 extends through another slotted opening 50 in the side wall from the exterior to the interior of the housing 52. The slotted openings 46, 50 are oversized and shaped so that portions of the leg 26 and strut 28, respectively, can freely move in and out without encountering too much or any frictional drag from scraping the edge of the openings.

The mounting tab 30, leg 26, elbow 32, and strut 28 are preferably made from a single piece of rigid material, such as steel. In order for the retainer clip 12, and specifically the leg portion to translate and swing as needed, even though the retainer clip itself needs to be generally rigid to support the entire assembly 10, there is provided a means for creating compliance. The means for creating compliance is preferably fitted to the mounting tab 30 and attaches the retainer clip 12 to the can housing 52. Thus, the rigid portions of the retainer clip 12 (that is, mounting tab 30, leg 26, elbow 32, strut 28 all move as a unitary structure) now have compliance as needed, and can move in several directions or degrees of freedom. In the preferred embodiment, the rigid portions of the retainer clip 12, and specifically the leg 26, can swing radially inward or outward where the elbow 32 strikes an arc. Also, the leg 26 can translate linearly up and down generally parallel to the side wall of the can housing 52. These two movements can occur independently or concurrently. The means for creating compliance further restricts the movements to the two degrees of freedom so the string clips 12 do not jam or encounter resistance when retracting or deploying.

As seen in FIG. 8, in the preferred embodiment, the means for creating compliance includes a bolt fastener 42 and a coiled spring 44 disposed on the bolt shaft. The head of the bolt 42 extends through the top wall 18 via a slotted opening. The opposite end of the bolt 42 preferably has threads that are screwed into the mounting tab 30. Captured in the space between the top wall 18 and the mounting tab 30 is the spring 44 which is placed in compression by the two structures. Advancing the bolt 42 into the mounting tab decreases the space and increases compression or stored energy in the spring 44. This reduces the compliance in the system; unscrewing the bolt out of the mounting tab increases compliance in the system. Reducing the compliance makes the retracting the legs 26 more difficult as there is more spring bias felt by the installer, and vice versa. Also, the slotted opening 48 (FIGS. 7(*a*), 13) that bolt 42 passes is an elongated hole, with the elongation extending radially from the center of the can housing 52. This elongated, oversized slotted opening 48 allows the bolt shaft to pivot or swing freely, which allows the leg to swing out and back. This pivoting or swinging action sequence of the bolt 42 can be best seen in comparing the angle of the bolt shaft in FIGS. 5 and 6. In FIG. 5, because the bolt 42 swings out within the slotted opening 48, this allows the leg 26 to swing freely inward to be relatively, substantially flush against the side wall of the can housing 52. The spring 44 is compressed in this state. As described above, the retraction of the legs 26 is accomplished under thumb and finger pressure. Once the installation is complete, the legs 26 are released and under the bias of compressed spring 44, the legs 26 pop radially outward. The bolt head, taking the opposite motion to the leg, swing inward as seen in FIG. 6.

The oversized, elongated opening 48 further enables the bolt 44, and by its physical connection, the entire spring clip 12 to translate upward and downward relative to the can housing 52. This is depicted in FIG. 5 where under thumb and finger pressure, the retainer clips 12 have been pushed and translated upward relative to the housing 52. Thus, it can be seen in FIG. 5 that the bolt head has moved a distance away from the top of the top wall 18. The spring 44 is compressed in this state. Once the finger and thumb pressure on the spring clips 12 is removed, the spring clips 12 again under spring bias are urged downward toward the open bottom of the can housing 52, as seen in FIG. 6. As a result, the bolt heads have also moved a distance closer to the top of the top wall 18.

Thus, in the deployed state, the spring bias continuously urges the legs 26 radially outward and downward as seen in FIG. 6. In the retracting state, the swiveling/pivoting action and translating action of the spring clips 12 described above can be achieved independently or can occur simultaneously. The two motions of each spring clip 12 are controlled by application of thumb and finger pressure of the installer. This gives the installer the most control to manipulate and wiggle the spring clips 12 into position for easy, quick installation, especially when standing atop a step ladder and working above head level.

The means for creating compliance can take other forms. For example, the coiled spring can be replaced with one or more bar springs. The bolt 42 may be threaded into the mounting tab 30 as described, or the bolt may be replaced by a shaft-like structure that is riveted, soldered, spot welded, or similarly secured into place on the mounting tab. Or the mounting tab, in one alternative embodiment, may have an extension (replacing the bolt) that passes through the slotted opening 48 and reciprocates and pivots as with the bolt. In yet another alternative embodiment, the bolt and spring combination is replaced by a coiled spring that is joined to the top wall 18 and the mounting tab 30 at opposite ends. The coiled spring enables the mounting tab 30, and by default due to its rigid structure, the retainer clip 12, to reciprocate/translate and swing/pivot in and out.

As best seen in the perspective view of FIG. 9(*a*), the retainer clip 12 in this preferred embodiment has a straight leg 26 with an optional flute or rib 36 embossed or formed into the leg to increase its rigidity. At the top of the leg 26 and preferably formed integrally with the leg is the mounting tab 30 having a fastener eyelet 38 and a block 34 spaced away directly underneath. At the bottom of the leg 26 is a strut 28, and where the strut and leg meet is an elbow 32. All of these components are preferably formed integrally, that is, formed from one continuous piece of material. At the free distal end of the strut 28 is a bent tip 40 for thumb/finger access by the installer or electrician. As mentioned above, the finger access is used to pull the legs 26 radially inward and to push the legs 26 upward from inside the housing 52. This feature is used for installation, or when outside access to the legs 26 is not possible after the can housing assembly 10 has been installed into the ceiling panel and replacement, repair or electrical work is desired.

As seen in the various views of FIGS. 9(*a*)-(*d*), the retainer clip 12 is formed from one piece of material, preferably a rigid steel strip that is stamped and bent. Or the part may be cast. The optional flute 36 is stamped or formed into the leg 26 to ensure that very little flexibility, bending, or twisting occurs in the leg in normal use because it is a load bearing member. The eyelet 38 is optionally reinforced to receive the bolt fastener 42 therethrough. In the side elevational view of FIG. 9(*c*), the leg 26 intersects the mounting tab 30 at an obtuse included angle while the leg 26 meets the strut 28 at the bottom forming an acute included angle. The upper mounting tab 30 and lower block 34 are generally parallel surfaces. The entire structure of the retainer clip 12 with the various bends is preferably very rigid with virtually no flexibility under normal operating conditions.

This rigidity is used to offset the combined weight of the can housing assembly, lamp or illumination source, electrical wiring, trim ring, optional reflector, optional LED driver, other miscellaneous hardware when installed in the ceiling space. The rigidity should be sufficient to carry the combined weight without apparent flexing in the spring clip, and remain stable when installed so that the entire unit does not topple over from normal environmental conditions.

FIG. 8 is a side elevational cutaway view of the can housing assembly 10. There are two retainer clips 12 shown, although more than two retainer clips can be used. Each mounting tab 30 receives its respective fastener 42, preferably a partially threaded bolt 42 therethrough. The shaft of the fastener 42 passes through a coiled spring 44. The threads of the fastener 42 are only at the end that screws into the mounting tab 30; the shaft at the bolt head end does not have any threads and has a smooth OD. This non-threaded shaft portion slides freely through an enlarged, slotted opening 48 in the top wall 18, as best seen in FIG. 7(*a*). In fact, in the upper view of the can housing 52, the slotted opening 48 has an enlarge circular opening at one end of the slot, which opening allows the head of the bolt 42 to pass through for easy assembly or disassembly. The bolt 42 can thus be pre-assembled to the mounting tab 30, and in one step, the bolt head can pass through the enlarged opening. Disassembly requires on sliding the bolt head through the slotted opening 48 to its enlarged end and pulling the bolt head through. The bolt 42 itself never needs to be unscrewed from the mounting tab 30, which reduces manufacturing and labor costs.

As seen in FIGS. 7-8, the retainer clip 12 thus has its mounting tab 30 region located inside the hollow, cylindrical, can housing 52. The top portion of the leg 26 extends from the mounting tab 30 out through an upper slot 46 in the housing 52 to the exterior, and slopes downward. At the bottom, the leg 26 is kinked inward at the elbow 32 leading to the strut 28, which terminates at the bent tip 40. Strut 28 passes through opening 50 as seen in FIG. 7(*a*). As each retainer clip 12 is deployed or retracted (FIGS. 3-6), a length of strut 28 freely reciprocates through slot 50. That is, there is preferably no or minimal contact between the strut 28 and the edges of the opening 50 so as to avoid or minimize friction or drag on the motion of the retainer clip 12. In this embodiment, part of the strut 28 and the bent tip 40 always remain inside the housing 52.

With this arrangement, the combination of the coiled spring 44 and bolt movement within the slotted opening 48 introduces compliance into a system which would otherwise be rigid. As such, the retainer clip 12 can be translated linearly upward in FIG. 8 to compress the coiled spring 44 between the underside of the top wall 18 and the mounting tab 30, thus pushing the bolt along its shaft such that the bolt head moves away from the top wall 18. Further, the retainer clip 12 may be rocked or swiveled from its position shown in FIG. 8 so that the previously outwardly flared leg 26 is now essentially flush alongside the outer wall of the housing 52. This rocking/swiveling action wherein the leg 26 moves radially inward is enabled by compressing the spring 44 and also by the head end of the bolt 42 pivoting outward within the slot-shaped opening 48.

A combination of the linear translation and rocking actions of the retainer clip 12 is shown FIG. 5 where the linear translation has lifted the bolt head away from the top wall 18, and simultaneously pivoted the bolt head away from the center of the housing 52. This process is used to retract the legs 26 to move them substantially flush against the sides of the housing 52 for installation. The actions act against the bias of the coiled spring 44, which is now compressed.

In FIG. 6, the restraining finger pressure of the installer on the retainer clips 12 has been removed. The now unopposed bias in the coiled spring 44 acts to return the retainer clip 12 to its original start position (FIGS. 7, 8) so that the retainer clip 12 has linearly translated downward moving the bolt head into contact with the top wall 18, and rocking the bolt head toward the center of the housing 52 while deploying the legs 26 radially outward (indicated by the arrows in FIG. 6). Once deployed, the legs 26 are used to support the can housing assembly 10 upon the ceiling panel 24. The weight of the assembly is supported at the elbow 32, and the bias in the coiled spring 44 creates more pressure to squeeze the ceiling panel 24 sandwiched between the elbow 32 and the lip 20. This creates a tight, quality fit between the housing 52 and the ceiling panel 24.

If the can assembly 10 needs to be removed, the installer or electrician can use his or her thumb/fingers to squeeze together the two bent tips 40 of the respective retainer clips 12 and push the clips upward. This radially inward pressure retracts the previously deployed legs 26 inward moving them generally or mostly flush against the outer wall of the housing 52 and the upward push removes the spring biasing pressure acting on the ceiling panel 24. The can housing assembly 10 can thus be pulled or dropped out of the ceiling cutout 22.

As seen in FIG. 8, the outward bias caused by the spring 44 never causes the legs 26 to overextend to a degree where the bent tip 40 actually touches or engages the inner wall of the housing 52. Indeed, FIG. 8 shows the full outer expansion of the legs 26. One mechanism in the preferred embodiment to prevent the overextension is the block 34 underneath the mounting tab 30 in each retainer clip 12. Any outward bias from the spring 44 with any momentum in the system caused by the outward bias is opposed by the block 34. Specifically, the radially outward rotational action of the leg 26 causes the block 34 to rotate radially outward to a point where an optional edge 54 of the block 34 or some portion of the block itself without the edge comes into contact with and abuts the interior of the housing 52, and this contact completely stops the radially outward travel of the leg 26. (The slight gap seen in FIG. 8 between the edge 54 of the block 34 and the inner wall of the housing 52 would be closed.) This is because the entire retainer clip structure is fairly rigid (except for the spring), so any movement in one part of the structure (i.e., the leg) translates to movement in another part of the structure (i.e., the block). Conversely, blocking movement in one part likewise blocks movement in another part. Further, after the can assembly 10 is installed and the legs 26 are deployed as in FIG. 8, the block 34 also stops the legs 26 from overly extending radially outward, which if it were to happen would not create a tight fit between the housing 52 and the ceiling panel 24.

Alternatively, the rocking action of the retainer clip 12 can be limited by the elongated size of the slotted opening 48. As seen in FIGS. 5 and 6 and described earlier, the bolt head and bolt shaft pivot or swivel along the longitudinal elongation of the opening 48. Thus, by limiting the elongation size of the opening 48, the bolt shaft at its pivot extremes engages the opposite edges of the slotted opening and can pivot no farther, as in FIGS. 5 and 6. Upon hitting the limits of the swiveling movement of the bolt 42, the swinging inward or outward movements of the leg 26 are likewise limited.

In various alternative embodiments, the swinging inward and outward movements of the legs 26 and/or retainer clips 12 may be achieved by the edge of the block 54 or the block 54 itself engaging the inner wall, or by the bolt shaft hitting the limits of the elongated slotted opening 48, or both.

Figure 11:
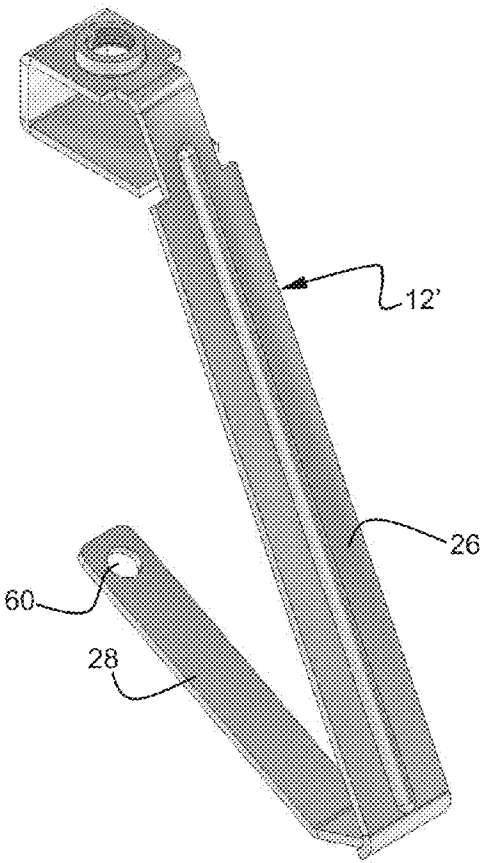
FIG. 11 is a perspective view of the alternative embodiment retainer clip shown in FIG. 10.
Figure 10:
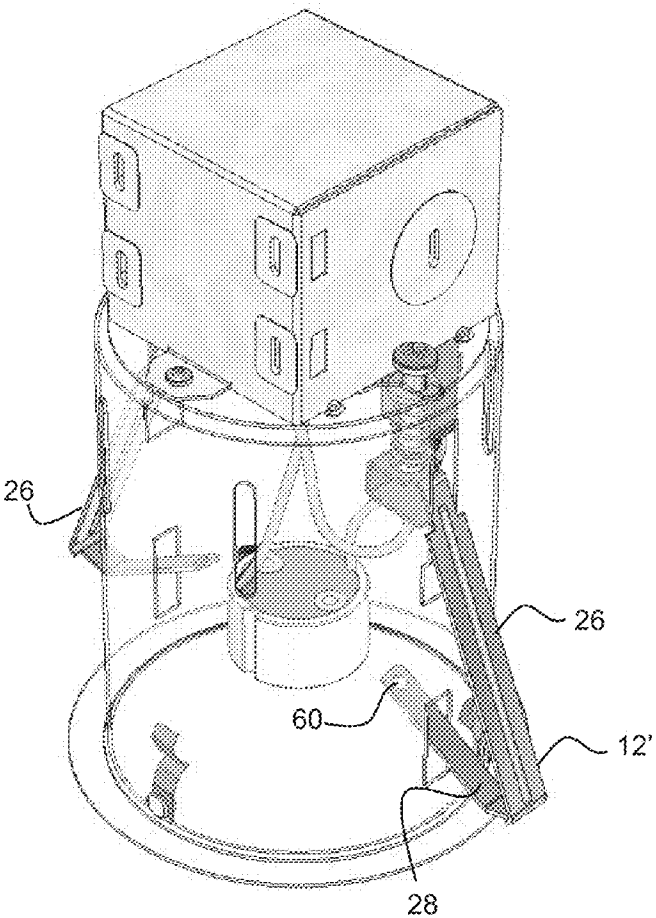
FIG. 10 is a perspective view of an alternative embodiment retainer clip used with a can housing assembly.

FIGS. 10-11 is a can assembly with an alternative embodiment retainer clip 12' shown in FIG. 11. The bent tip has been replaced by a straight section with a hole 60 in the strut 28, which the installer or electrician can use to hook with the tip of a screwdriver. With the screwdriver tip inserted into the hole 60, the deployed leg 26 can be retracted, against the bias from the coiled spring 44, to be retracted generally flush against the outer wall of the can housing 52.

Figure 13:
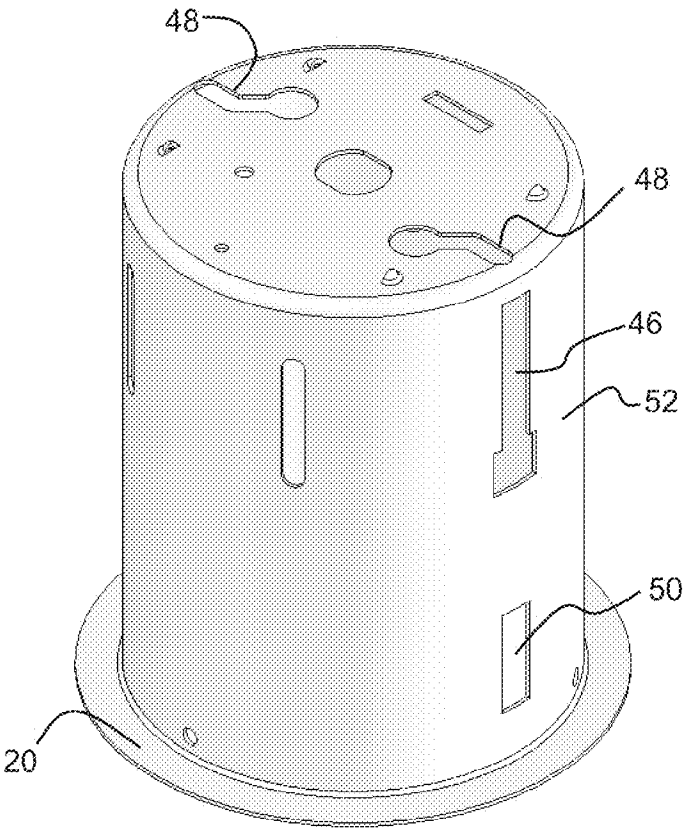
FIG. 13 is a perspective view of the can housing from FIG. 12.
Figure 12:
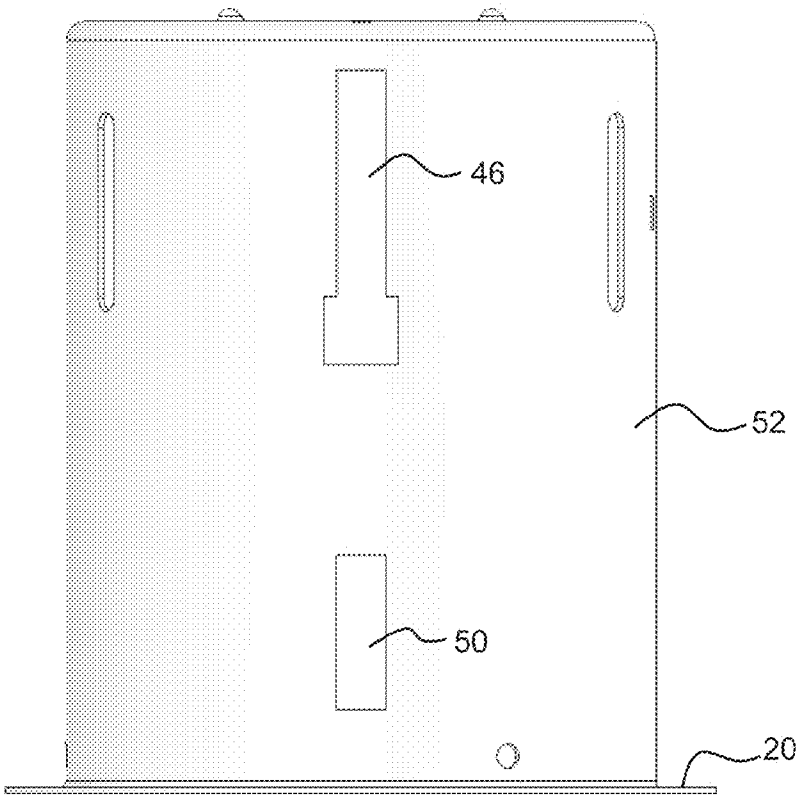
FIG. 12 is a side elevational view of a preferred embodiment can housing
Figure 14A:
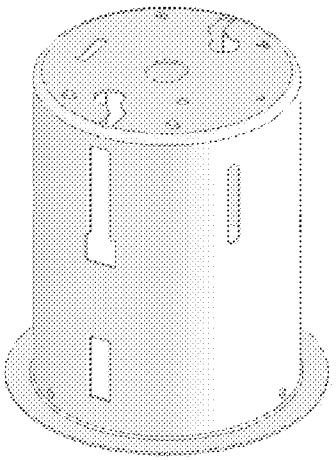
FIGS. 14(*a*)-14(*f*) are various views of an alternative embodiment can housing.
Figure 14B:
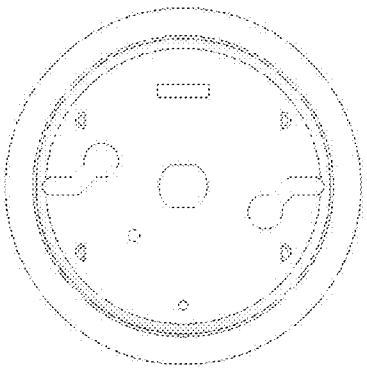
Figure 14C:
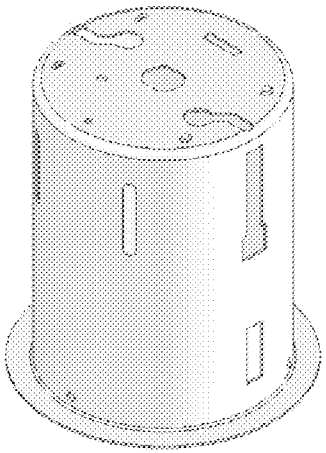
Figure 14D:
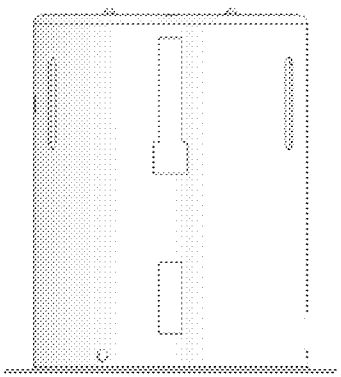
Figure 14E:
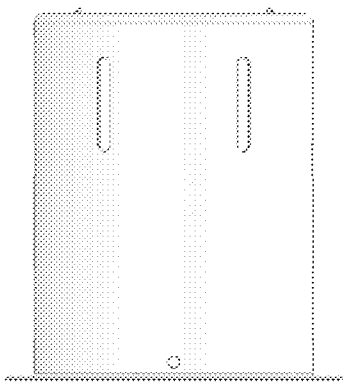
Figure 14F:
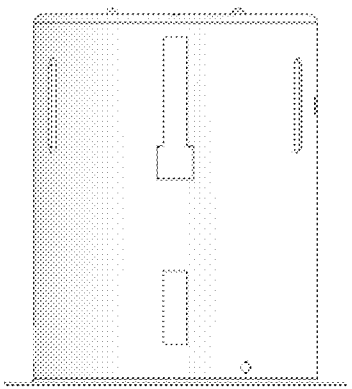

FIGS. 12 and 13 are a side elevational and perspective views of the can housing 52 in the exemplary embodiment shown in FIGS. 7-9 described above. Other slots and ports may be included in the housing 52 as shown for ventilation and cooling of the light source, to receive more electrical wiring, to mount lighting fixture hardware, or to receive fasteners. Slotted opening 48 may have the hooked keyhole shape with the enlarged opening at one end to facilitate assembly of the bolt 42 thereto without removing the bolt from the mounting tab 30. Inverted T-shaped upper slot 46 further enables assembly, and the wider T area allows for easy assembly of the spring clip 12 to the can housing 52 by allowing portions of the strut or distal tip of the strut to pass through if necessary. FIGS. 14(*a*)-14(*f*) are various views of the can housing 52 from FIGS. 12-13.

Figure 15B:
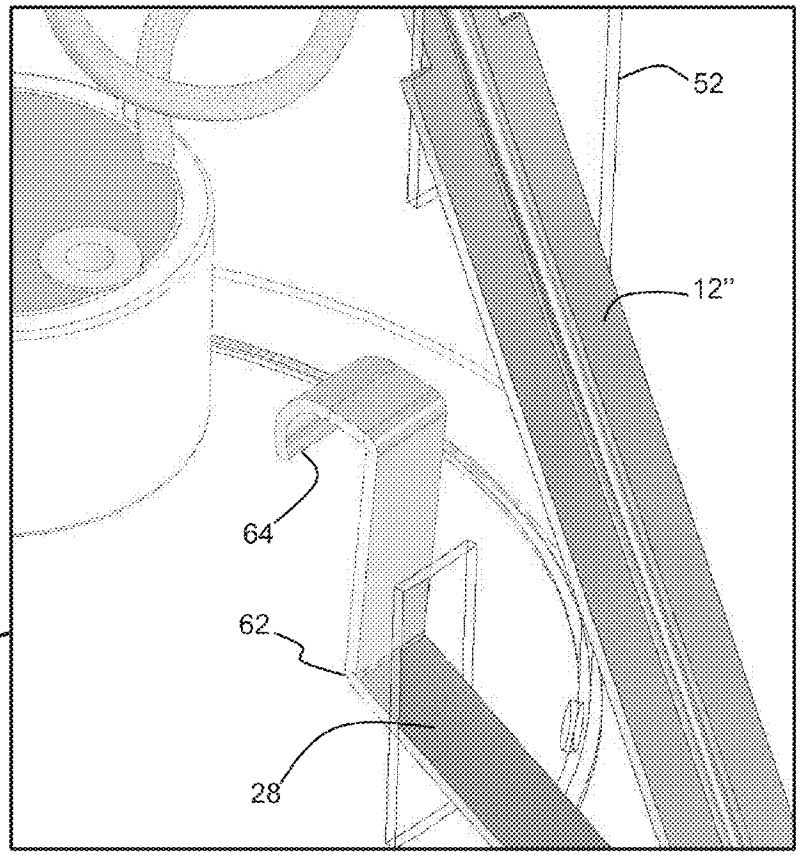
FIGS. 15(*a*)-15(*b*) are perspective views of a can housing assembly with an alternative embodiment retainer clip.
Figure 15A:
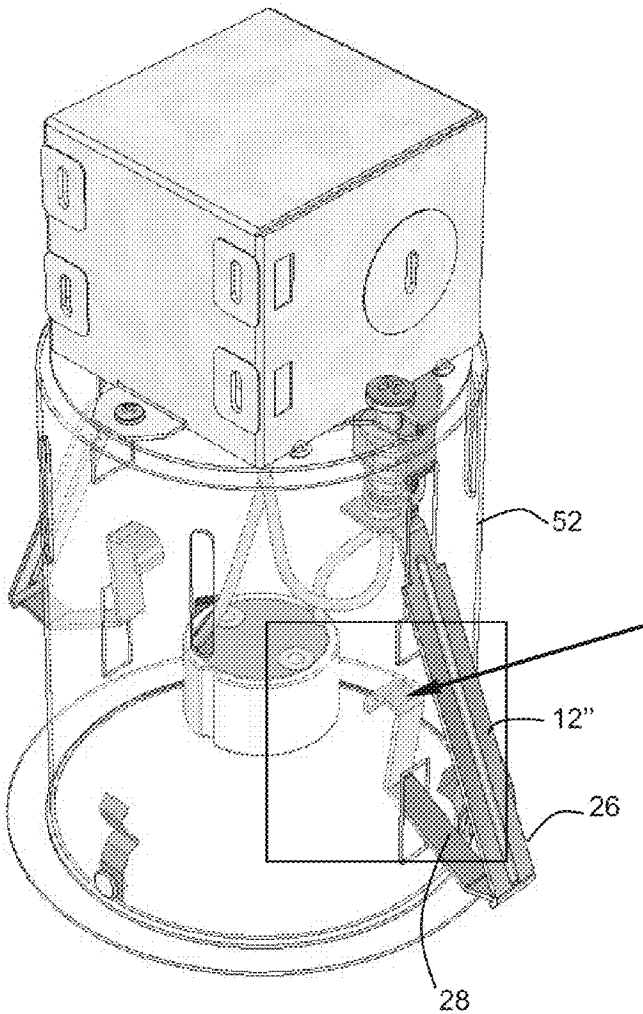
Figure 16:
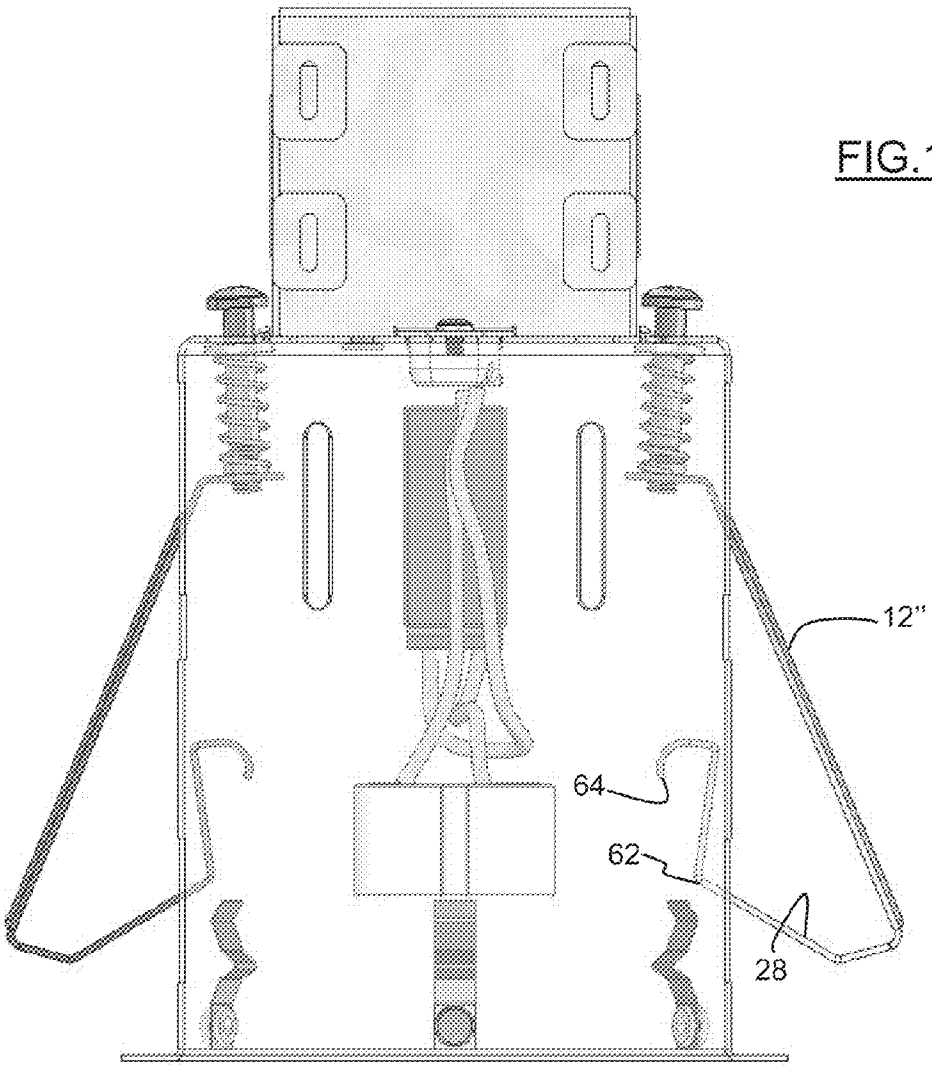
FIG. 16 is a side elevational cutaway view of the embodiment shown in FIG. 15.
Figure 17A:
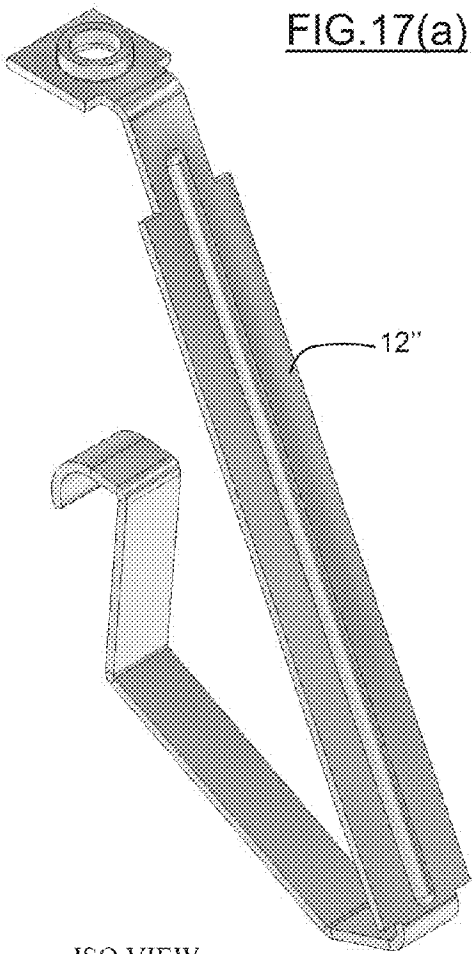
FIGS. 17(*a*)-17(*d*) are various views of the alternative embodiment retainer clip shown in FIG. 15.
Figure 17D:
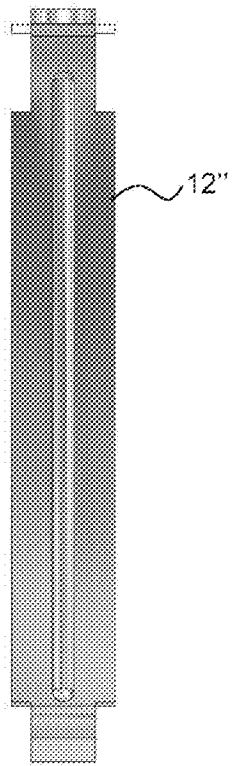
Figure 17B:
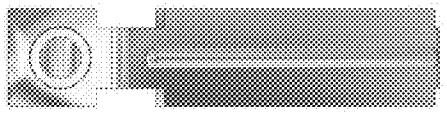
Figure 17C:
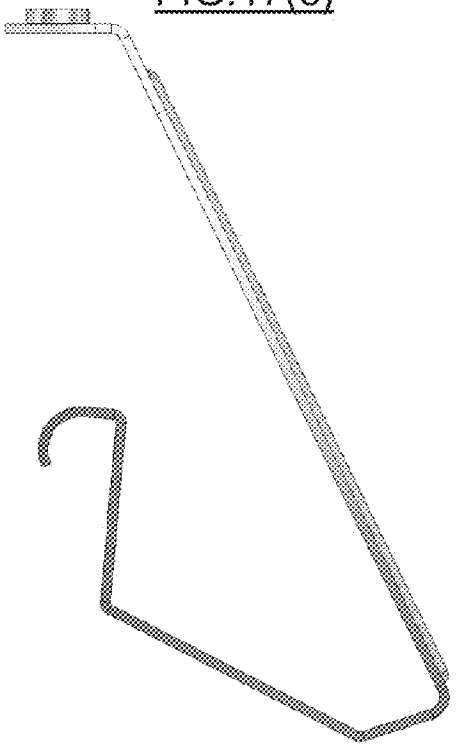

FIGS. 15-17 show a recessed can assembly housing 52 using yet another alternative embodiment retainer clip 12". This embodiment has a bent distal tip 62 that bends the distal end upward toward the top wall, with a curled hook 64 that bends back downward toward the open bottom. Because the open bottom of the can housing 52 is where the installer reaches up into the can housing, the curled hook 64 gives the installer easy gripping or pressure points for thumb/finger manipulation to retract the legs 26 and to push the retainer clip 12" upward against the bias of the coiled spring. FIGS. 17(*a*)-17(*d*) are different views of the retainer clip 12" only.

Unless otherwise described herein, conventional materials and manufacturing methods may be used to make the present invention. Additionally, various modifications may be made to the present invention without departing from the scope thereof. Although individual features of embodiments of the invention may be shown in some of the drawings and not in others, those skilled in the art will recognize that individual features of one embodiment of the invention can be combined with any or all of the features of another embodiment.

We claim:

1. A recessed ceiling light fixture, comprising:

a housing having a side wall, a top wall up on top, and an open bottom with a lip at the bottom;

a plurality of openings in the side wall;

at least one rigid retainer clip having a mounting tab inside the housing extending into a leg that passes through one of the openings out of the housing, which leg is bent at a distal end to form an elbow, which elbow extends to a strut passing through one of the openings into the housing, wherein the mounting tab selectively engages an interior of the side wall;

means for creating compliance extending loosely through a slotted opening in the top wall and connecting to the mounting tab, wherein the means for creating compliance simultaneously biases the leg to swing away from the side wall and downward toward the open bottom; and wherein the leg swing away from the side wall under spring bias is limited by at least one of the mounting tab engaging the side wall and the means for creating compliance engaging a lip of the slotted opening in the top wall.

2. The recessed ceiling light fixture of claim 1, wherein rigid retainer clip has a rigidity to support the weight of the recessed ceiling light fixture with minimal flexing.

3. The recessed ceiling light fixture of claim 1, wherein the leg includes a plank shape with a rib extending along a length thereof.

4. The recessed ceiling light fixture of claim 1, wherein the means for creating compliance includes a bolt and a coiled spring disposed around the shaft of the bolt, and wherein the bolt passes loosely through the slotted opening in the top wall at one end and is attached to the mounting tab at an opposite end.

5. The recessed ceiling light fixture of claim 4, wherein the bolt includes a bolt head at one end disposed outside of the housing and threads at an opposite end screwed into the mounting tab, and turning the bolt head changes the distance between the mounting tab and the top wall thereby changing the amount of force on the spring.

6. The recessed ceiling light fixture of claim 1, wherein the means for creating compliance includes a shaft extending from the mounting tab and passing loosely through the slotted opening in the top wall, and wherein a spring is disposed with the shaft to press against the top wall and the mounting tab.

7. The recessed ceiling light fixture of claim 1, wherein a distal end of the strut includes at least one of a hook, a bend, a T-shaped tip, and a tab having a hole therethrough.

8. The recessed ceiling light fixture of claim 1, wherein the interior of the housing includes mounting hardware.

9. The recessed ceiling light fixture of claim 1, wherein the plurality of openings in the side wall are T-shaped.

10. A recessed ceiling light fixture, comprising:

a cylindrical housing having a side wall, a top wall up on top, and an open bottom with a lip at the bottom;

a plurality of openings in the side wall;

two retainer clips mounted diametrically opposed on the housing, each retainer clip having a mounting tab inside the housing extending into a leg that passes through one of the openings out of the housing, which leg is bent at a distal end to form an elbow, which elbow extends to a strut, wherein the mounting tab selectively engages an interior of the side wall;

means for creating compliance passing loosely through a slotted opening in the top wall and joined to the retainer clip via the mounting tab, wherein the means for creating compliance simultaneously biases the leg to swing away from the side wall, and to translate the leg downward toward the open bottom; and wherein the leg swing motion away from the side wall is limited at least by the mounting tab bumping into the side wall.

11. The recessed ceiling light fixture of claim 10, wherein the means for creating compliance includes a bolt and a coiled spring disposed on the shaft of the bolt, and wherein the bolt passes loosely through the slotted opening in the top wall at one end and is attached to the mounting tab at an opposite end, and the spring is compressed therebetween, and wherein the bolt shaft freely pivots along the slot and translates through the slotted opening.

12. The recessed ceiling light fixture of claim 10, wherein a distal end of the strut passes through one of the openings into the housing, and the distal end further includes at least one of a hook, a bend, a T-shaped tip, and a tab having a hole therethrough.

13. The recessed ceiling light fixture of claim 11, wherein the slotted opening in top wall enables the bolt to freely swivel along the direction of the slot and to freely translate through the slot thereby creating compliance in the spring clip.

14. A recessed ceiling light fixture, comprising:

a can shaped housing having a side wall, a top wall, and an open bottom with a lip at the bottom;

a plurality of slots in the side wall;

a plurality of retainer clips, each retainer clip having a mounting tab inside the housing extending into a leg that passes through one of the slots out of the housing, which leg is bent at a distal end to form an elbow, which elbow extends to a strut passing through one of the slots into the housing, wherein the mounting tab selectively engages an interior of the side wall;

means for creating compliance passing loosely through an oversized opening in the top wall and connected to the mounting tab, wherein the means for creating compliance enables the retainer clip to have at most two degrees of freedom in movement of each leg; and wherein one of the degrees of freedom in the leg movement includes biasing the leg to pivot away from the side wall of the housing, which pivoting movement causes movement of the mounting tab and means for creating compliance such that at least one of the mounting tab and means for creating compliance selectively engages the side wall and top wall, respectively, thereby limiting the pivoting movement of the leg.

15. The recessed ceiling light fixture of claim 14, wherein the means for creating compliance includes a bolt having a bolt head at one end disposed outside of the housing and threads at an opposite end screwed into the mounting tab, and a spring disposed on the bolt, so turning the bolt head changes the distance between the mounting tab and the top wall thereby changing the amount of compression on the spring.

16. The recessed ceiling light fixture of claim 14, wherein the mounting tab includes a protruding surface that selectively engages the side wall to limit the pivoting movement of the leg.

17. The recessed ceiling light fixture of claim 16, wherein mounting tab includes a C shape with the top of the C receiving the threaded end of the bolt, and the bottom of the C having the protruding surface that selective engages the side wall to thereby limit the pivoting movement of the leg.

18. The recessed ceiling light fixture of claim 14, wherein the strut at a distal end thereof inside the housing includes a tip bent toward the open bottom.

19. The recessed ceiling light fixture of claim 14, wherein another of the two degrees of freedom includes linear translation of the leg under bias downward relative to the housing top and bottom, and wherein the means for creating compliance creates bias in the leg pivot and the bias in the leg translation simultaneously.

20. The recessed ceiling light fixture of claim 14, wherein the mounting tab, leg, elbow, and strut are formed in one integral piece of material for rigidity.

* * * * *